US005151000A

United States Patent [19]

Geraghty et al.

[11] Patent Number: 5,151,000

[45] Date of Patent: Sep. 29, 1992

[54] PELLET STOVE FEEDER

[75] Inventors: Rod Geraghty, 15731 SE. 224th, Kent, Wash. 98042; Robert D. Burgess, Seattle, Wash.

[73] Assignee: Rod Geraghty, Kent, Wash.

[21] Appl. No.: 719,910

[22] Filed: Jun. 24, 1991

[51] Int. Cl.[5] ..... F23K 3/12

[52] U.S. Cl. ..... 414/187; 110/248; 110/282; 414/172; 414/198; 414/199; 414/208

[58] Field of Search ..... 414/156, 160, 161, 172, 414/176, 180, 187, 194, 198, 199, 208; 222/349; 110/248, 281, 282, 284, 293

[56] References Cited

U.S. PATENT DOCUMENTS

| | | | |
|---|---|---|---|
| 701,192 | 5/1902 | Fraser . | |
| 770,786 | 9/1904 | Strouse | 414/176 |
| 820,528 | 5/1906 | Southam | 414/176 |
| 1,442,295 | 1/1923 | Porter . | |
| 1,942,947 | 1/1934 | Strange | 110/108 |
| 2,078,640 | 4/1937 | Segar | 110/109 |
| 2,204,555 | 6/1940 | Valentine et al. | 110/109 |
| 2,390,062 | 12/1945 | French | 414/176 |
| 2,423,110 | 7/1947 | Mosshart | 414/176 X |
| 2,441,366 | 5/1948 | Mosshart | 414/176 X |
| 2,486,570 | 11/1949 | Mosshart et al. | 414/176 X |
| 2,873,846 | 2/1959 | Urquhart | 414/176 X |
| 2,932,264 | 4/1960 | Hurst | 110/282 X |
| 2,990,975 | 7/1961 | Sereno | 222/349 X |
| 3,855,950 | 12/1974 | Hughes, Jr. et al. | 414/187 X |
| 4,137,854 | 2/1979 | Lattin | 222/349 X |
| 4,328,786 | 5/1982 | Owen | 126/174 |
| 4,474,117 | 10/1984 | Marollaud | 110/109 |
| 4,536,120 | 8/1985 | Kylmänen et al. | 414/173 |
| 4,537,140 | 8/1985 | Baker | 110/281 |
| 4,562,777 | 1/1986 | van der Voort | 110/293 X |
| 4,665,840 | 5/1987 | Yarnell | 110/282 X |
| 4,714,031 | 12/1987 | Healy et al. | 414/198 X |
| 4,718,360 | 1/1988 | Giaier et al. | 414/187 X |
| 5,009,769 | 3/1992 | Petrie et al. | 110/293 X |

OTHER PUBLICATIONS

Brochure titled "The Inside Story on the Most Significant Improvements in Pellet Stove Technology", concerning pellet stoves sold under the trademark Eclipse by Horizon Research, Inc., Bothell, Washington, published prior to 1990.

*Primary Examiner*—Michael S. Huppert
*Assistant Examiner*—Robert S. Katz
*Attorney, Agent, or Firm*—Robert W. Beach; Ward Brown

[57] ABSTRACT

A hopper containing fuel pellets for a stove opens downward into a feed trough which extends generally horizontally toward the firebox of the stove. A feed plate is positioned such that pellets from the hopper are supported on the feed plate. The feed plate is reciprocated between a rearward position adjacent to the hopper and a forward position adjacent to the firebox so as to advance pellets toward the firebox. A gate member is mounted adjacent to the end of the feed trough remote from the hopper. The gate member is positioned to be engaged by the feed plate when the feed plate is in its forward position so as to close the feed trough and hopper from the firebox. The mechanism for reciprocating the feed plate normally maintains it in its forward position in which the feed trough and hopper are isolated from the firebox.

10 Claims, 4 Drawing Sheets

PELLET STOVE FEEDER

BACKGROUND OF THE INVENTION

1. Field of the Invention

The present invention relates to fuel feed mechanism for feeding pelletized fuel from a hopper to the firebox of a stove.

2. Prior Art

In known pellet stoves mechanism is provided for automatically feeding pelletized fuel to the firebox at approximately a uniform, sometimes adjustable, rate. Preferably such stoves are self-feeding for an extended period, such as several hours.

In a positive feed system, the fuel is forcefully moved to the firebox. Known systems use augers or screw conveyors which pulverize some of the fuel pellets and which can become jammed. Another type of positive feed system is shown in U.S. Pat. No. 4,536,120, issued Aug. 20, 1985, to Kylmänen et al. and U.S. Pat. No. 4,474,117, issued Oct. 2, 1984, to Marollaud. In the device of each of those patents, a piston is reciprocated horizontally below the bottom outlet opening of a hopper to move pelletized fuel from the hopper along a feed cylinder or trough. In the piston feeder of the Marollaud patent, the piston is stated to form a "fire barrier" in its "rest position". See the paragraph beginning a column 2, line 38 and the first three paragraphs of column 4.

As an alternative to a positive feed system, one known system uses a rotating tube inclined downward from the bottom of a hopper to a chute leading to the firebox. Fuel pellets are tumbled in the tube and slide and roll downward along it to the chute. See the brochure titled "The Inside Story on the Most Significant Improvements in Pellet Stove Technology" concerning pellet stoves sold under the trademark "Eclipse" by Horizon Research, Inc., of Bothell, Wash.

Other types of "passive" feed systems which have been used for coal burning stoves or boilers are shown in the following U.S. patents:

U.S. Pat. No. 701,192, issued May 27, 1902 (Fraser);
U.S. Pat. No. 1,442,295, issued Jan. 16, 1923 (Porter);
U.S. Pat. No. 1,942,947, issued Jan. 9, 1934 (Strange);
U.S. Pat. No. 2,078,640, issued Apr. 27, 1937 (Segar);
U.S. Pat. No. 2,204,555, issued Jun. 18, 1940 (Valentine et al.);
U.S. Pat. No. 4,537,140, issued Aug. 27, 1985 (Baker);
U.S. Pat. No. 4,328,786, issued May 11, 1982 (Owen).

In the feed mechanism of each of the above devices, lumps of coal are fed to a firebox by reciprocating, oscillating or vibratory motion of a feed plate or trough positioned below the bottom outlet of a hopper.

In the passive feed devices, there can be a danger that the fire will spread along the feed trough or plate, possibly to the hopper.

SUMMARY OF THE INVENTION

The principal object of the present invention is to provide mechanism for feeding pelletized fuel to the firebox of a stove safely, reliably and at an adjustable rate for an extended period.

It also is an object to provide such mechanism of simple, inexpensive design but durable and substantially maintenance free.

Another object is to provide such mechanism which does not damage the fuel pellets so that their burn characteristics are not affected.

An additional object is to provide such mechanism in a form eliminating or at least greatly lessening the possibility of fire spreading from the firebox through the feed mechanism to a stored quantity of the pelletized fuel.

In the preferred embodiment of the present invention, the foregoing objects are accomplished by providing a pellet hopper having a bottom outlet opening, a feed trough extending generally horizontally from below the hopper outlet opening toward the firebox of the stove, a feed plate mounted in the feed trough and reciprocated therein between a rearward position and a forward position for advancing pellets from the hopper toward the firebox, and a gate member mounted adjacent to the end of the feed trough remote from the hopper and positioned to be engaged by the feed plate when the feed plate is in its forward position. The gate member closes the feed trough and the hopper from the firebox when the plate is in its forward position.

The mechanism for reciprocating the feed plate normally maintains the feed plate in its forward position such that the feed trough and hopper are normally isolated from the firebox. After a predetermined time delay, the feed plate is moved to its rearward position then to its forward position where it is again maintained for the predetermined delay. The length of the delay can be adjusted to adjust the effective rate at which the feed plate is reciprocated which, in turn, adjusts the effective rate at which pellets are fed from the hopper to the firebox.

DETAILED DESCRIPTION

Figure 1:
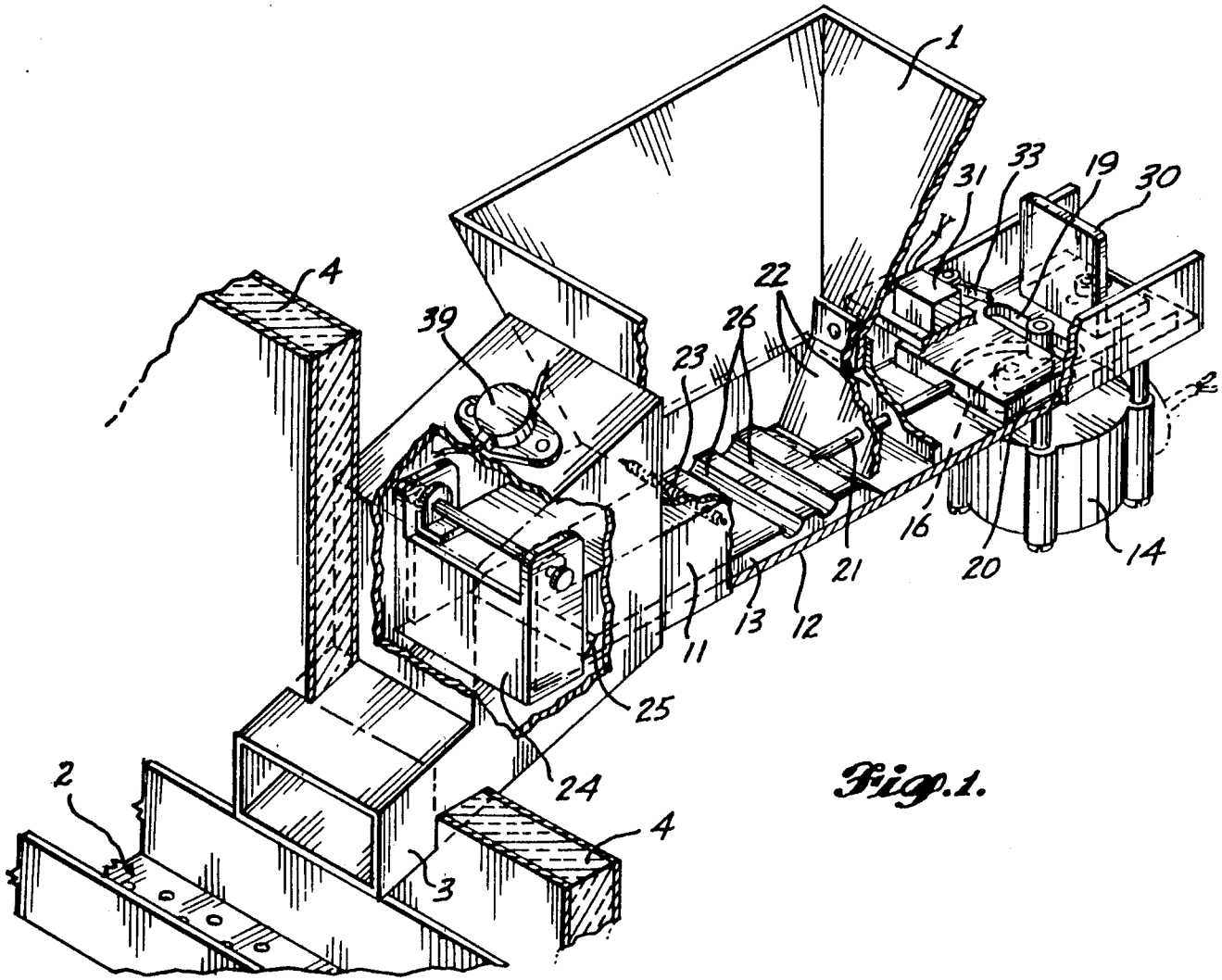
FIG. 1 is a top perspective of a pellet stove feeder in accordance with the present invention with parts broken away.
Figure 2:
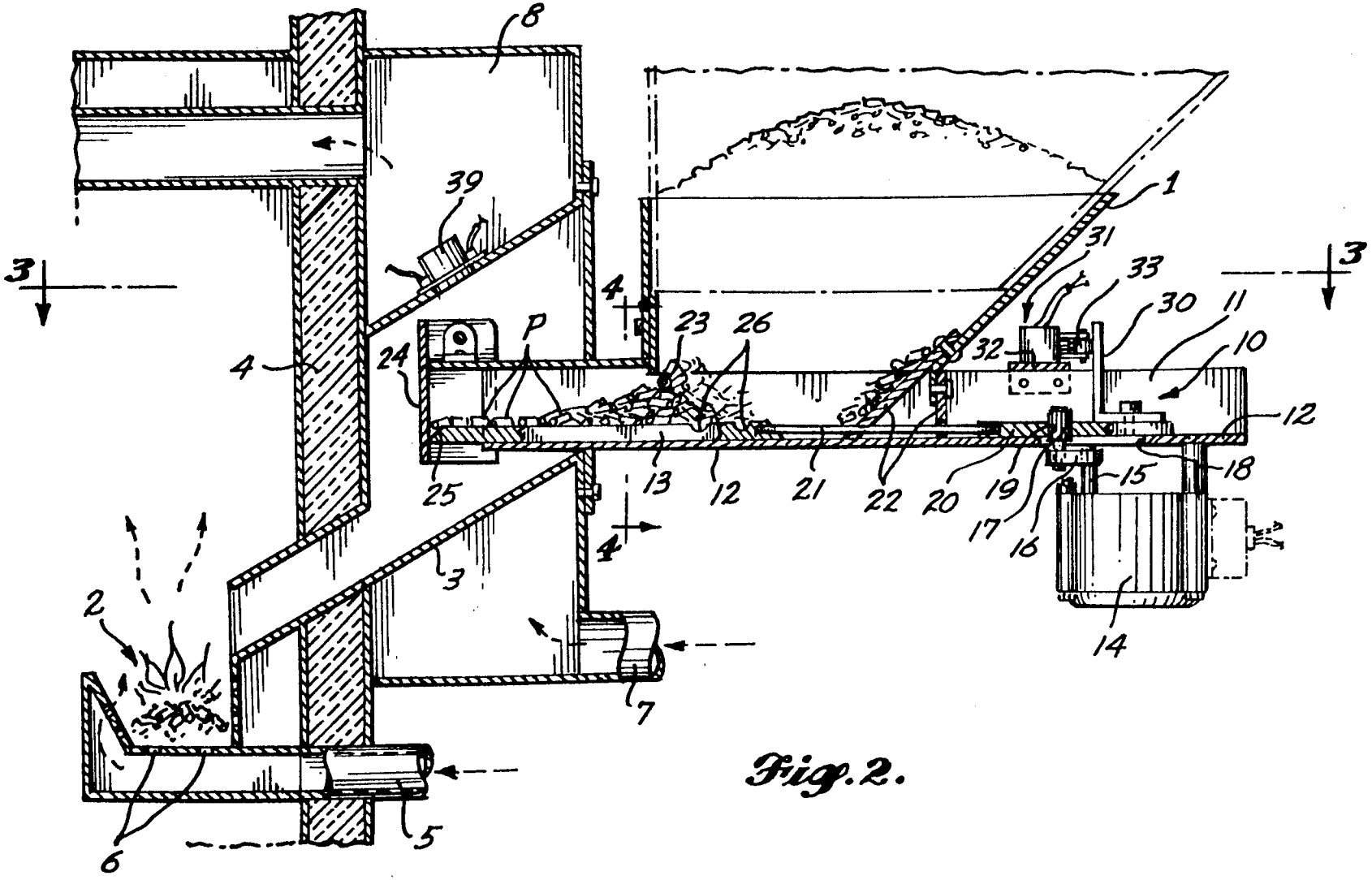
FIG. 2 is a somewhat digametic side elevation of the pellet stove feeder of FIG. 1 with parts shown in section.

With reference to FIG. 1 and FIG. 2, the pellet stove feeder in accordance with the present invention is used to feed pelletized fuel from a hopper 1 to the firebox 2 of a pellet stove, such as by way of an inclined feed chute 3. The firebox is lined by insulated walls including a rear wall 4 through which the feed chute 3 extends. As seen in FIG. 2, combustion air can be supplied through a conduit 5 to an apertured grate 6 of the firebox. Thereafter the combustion air is discharged through a conventional chimney or vent. For most efficient use, a separate supply of air can be blown through a conduit 7 to a heat exchange plenum 8 substantially surrounding the firebox and then into a space to be heated. The interior construction of the stove and the air circulation system are conventional.

The novelty of the present invention resides in the specific feeder used to transport the pelletized fuel from the hopper to the firebox. The hopper 1 is mounted on an elongated feed trough or channel 10 having opposite upright sidewalls 11 connected by the horizontal baseplate 12. The hopper is substantially centered over the trough and opens into it. A reciprocating feed plate 13 is supported on and slidable over the baseplate 12. The opposite edges of the feed plate are in close proximity to the facing surfaces of the sidewalls 11.

Figure 3:
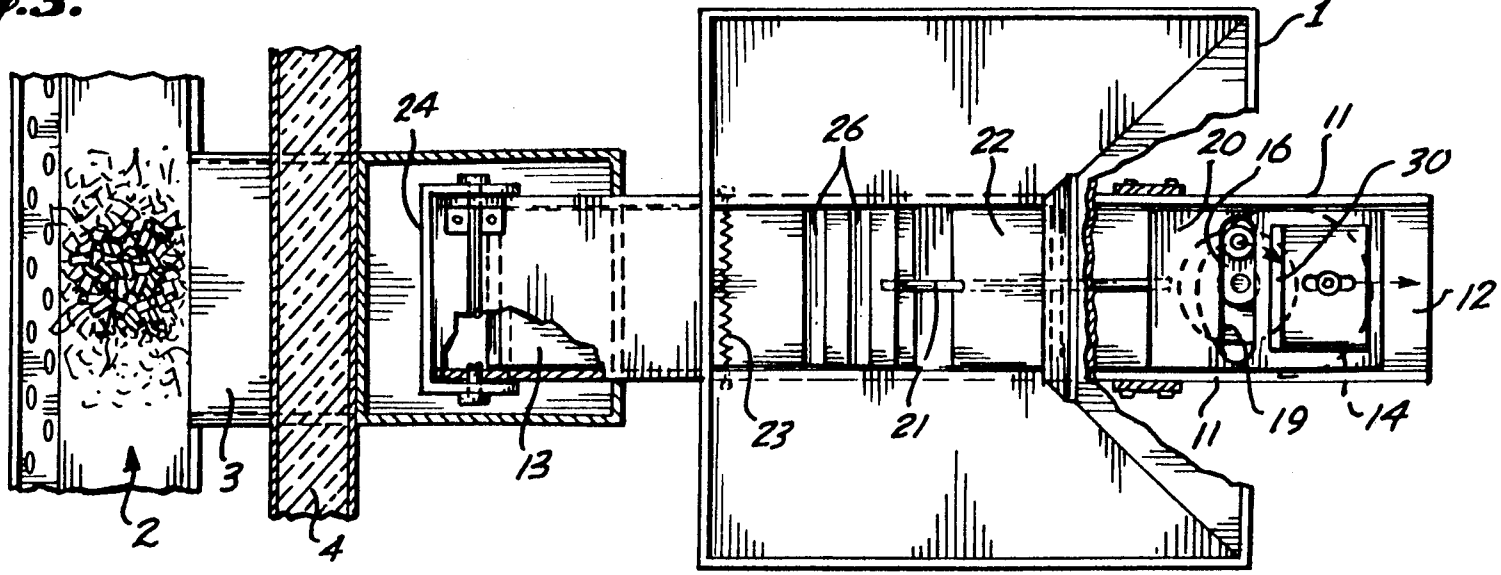
FIG. 3 is a horizontal section along line 3—3 of FIG. 2 with parts broken away.
Figure 4:
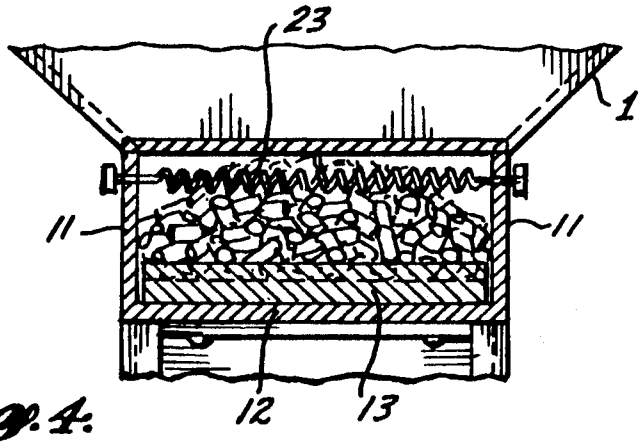
FIG. 4 is a vertical section along line 4—4 of FIG. 2.

The feed plate 13 is moved by the action of a motor 14 which is supported from the trough 10. Such motor has a rotary output shaft 15 with an eccentric drive link 16 including cam roller 17 extending through a circular aperture 18 in the channel baseplate 12. Such roller is received in an elongated slot 19 through a horizontal drive plate 20 which is slidable horizontally in the rear portion of the trough 10 behind the hopper 1. Drive plate 20 is interconnected with feed plate 13 by a connecting rod 21 extending forward from the drive plate through aligned holes in the double rear wall 22 of the hopper. Slot 19 in the drive plate 20 has its length extending transversely of the length of the feed trough or channel 10. Consequently, rotation of the drive shaft has the effect of reciprocating the plates 13 and 20 fore and aft. FIG. 1 shows the most rearward shifted position of the plates (the eccentric drive link 16 is pointed to the right), whereas FIG. 2 shows the most forward shifted position of the plates (the eccentric drive link 16 is pointed to the left). FIG. 3 shows an intermediate position of the plates (the eccentric drive link 16 extends transversely of the length of the feed trough 10).

With reference to FIG. 2, the bottom of the hopper 1 opens into the central portion of the feed trough 10 above the feed plate 13, but the double rear wall 22 closes the interior of the hopper from the rear end portion of the trough. Reciprocating motion of the feed plate causes pellets to advance toward the feed chute 3. For example, when the feed plate is moved rearward, that is, to the right from the position shown in FIG. 2, the pellets P supported on the forward tip portion of the feed plate cannot move rearward with it because of the mound of pellets immediately to the rear. The feed plate is retracted out from beneath such pellets P which fall downward onto the chute 3 and into the firebox 2. Preferably grooves 26 are provided in the upper surface of the feed plate directly below the bottom opening of the hopper 1 to assist in shifting the pellets forward during the return stroke of the feed plate.

Because of the close proximity of the bottom of the hopper to the upper surface of the feed plate, there could be a tendency for a clump or mound of pellets to become lodged at the leading edge of the hopper opening. In accordance with the present invention, a resilient member, preferably a tightly coiled helical spring 23, extends across the feed trough or channel 10 in the area of the hopper opening which decreases any tendency of a clump or mound of pellets becoming lodged or jammed at that location. The pellets will not bridge immovably between such a resilient member and the upper surface of the feed plate as could occur if the resilient member were deleted or a rigid baffle member were used.

One problem with known feeders for pellet stoves is that the fire may spread through the feed mechanism. In accordance with the present invention, an upright gate member 24 is provided which, in combination with the leading tip portion of the feed plate 13, normally closes the trough 10 and hopper 1 from the firebox. As seen in FIG. 2, in the forward position of the feed plate its beveled tip 25 is in very close proximity to, preferably in engagement with, the gate 24. Such gate can have a shallow groove, slot or depression into which the pointed tip of the feed plate 13 fits. Preferably the gate member 24 is pivotally mounted relative to the feed trough so as to swing outward if a pellet is caught between the tip of the feed plate and the gate as the feed plate moves forward. Such pellet will slide downward along the beveled tip portion 25 of the feed plate into the feed chute 3, thereby allowing the gate member 24 to return to the position shown in FIG. 2 to which the gate member is biased by gravity.

As discussed above, in the forward position of the feed plate 13 the gate member 24 and forward tip portion 25 of the feed plate close the feed trough 10 and hopper 1 from the firebox. In accordance with the present invention, control mechanism is provided to assure that the feed plate always stops at its forward position. Thereafter, the motor is actuated at predetermined intervals to rotate its drive shaft precisely one revolution so as to feed a quantity of pellets onto the chute 3. The feed plate is immediately moved forward again to close the opening from the feed trough to the firebox while advancing the next batch of pellets to be discharged. The rate of discharge of the pellets is controlled by selecting the period of time between revolutions of the motor drive shaft.

Figure 5:
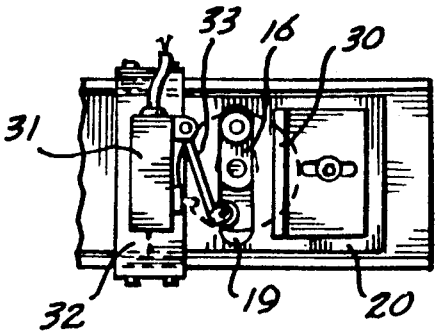
FIG. 5 is a fragmentary top plan of a portion of the feeder in accordance with the present invention, namely, a limit switch and adjacent structure for sensing the position of a reciprocating feed plate.

Toward its rear end the drive plate 20 carries an upward projecting finger 30 which cooperates with a limit switch 31 mounted on a plate or bracket 32 bridging between the sidewalls 11 of the feed trough. The limit switch includes an actuating lever 33 normally biased rearward but movable forward by engagement against the feed plate finger 30. The position of finger 30 is adjusted so that the limit switch is actuated only when the feed plate is in its forward position. The arrangement of the limit switch 31 and finger 30 are best seen in FIG. 5. The limit switch can be a 4775 series "SnapAction" limit switch available from McGill Manufacturing Company, Inc., of Valparaiso, Ind.

Figure 6:
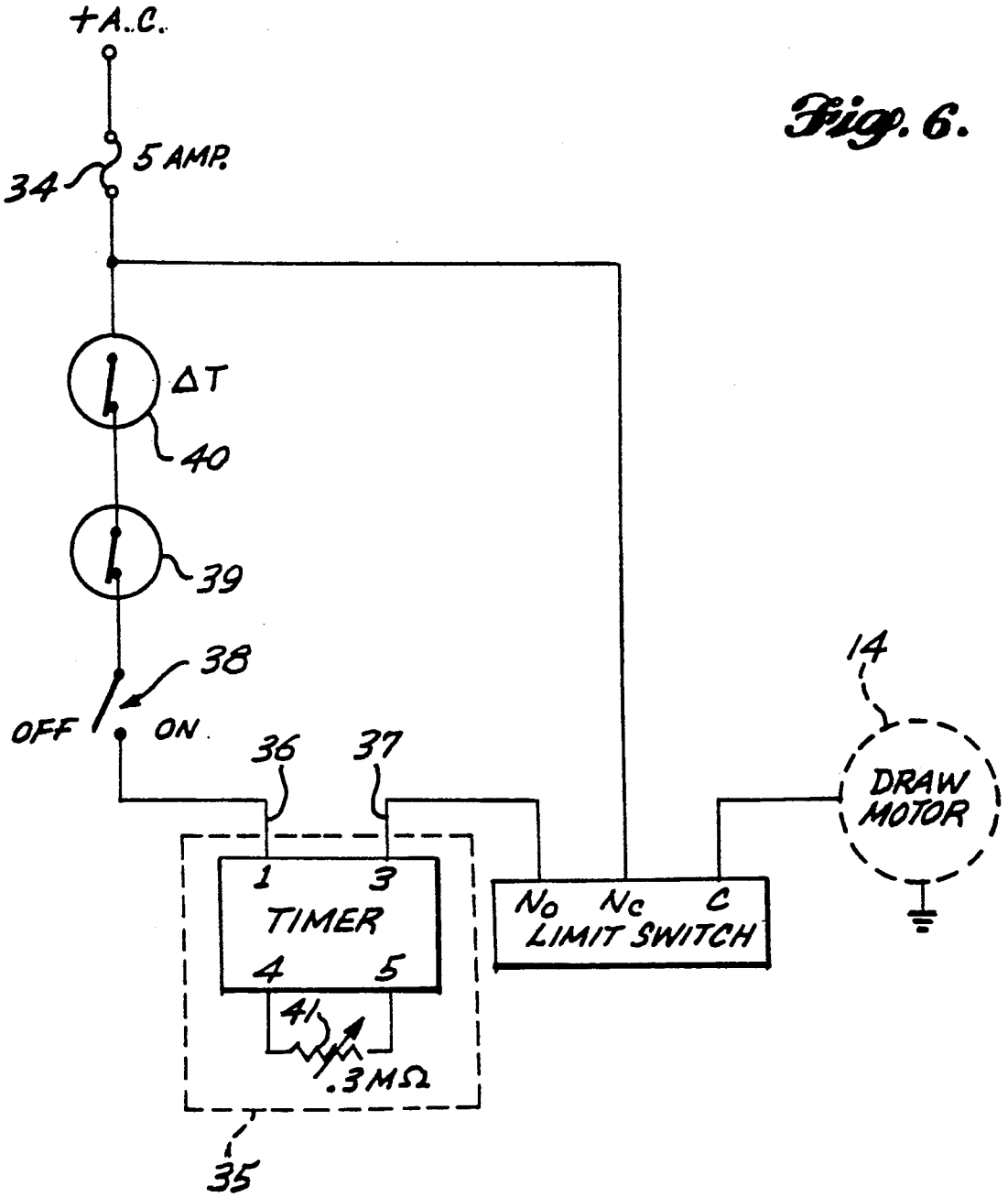
FIG. 6 is a diagram of the electrical circuit used in the pellet stove feeder in accordance with the present invention.

The circuit for the feeder in accordance with the present invention is shown in FIG. 6. Limit switch 31 includes a "common" terminal C, a "normally closed" terminal NC connected to the common terminal C except when the limit switch is actuated by movement of the feed plate to its forward position and a "normally open" terminal NO which is connected to terminal C only when the feed plate is in its forward position. Terminal NC is connected to a source of AC power for the motor 14 through a standard fuse 34.

Contact NO of the limit switch is connected to a timer circuit 35 which is configured as a "delay on make" timer with automatic reset. The connections shown are for the preferred timer which is a TS1 series timer sold under the trademark "Versa-Timer" by SSAC Inc., of Baldwinsville, N.Y. Upon application of power to such a timer circuit, a time delay is initiated following which power fed to the timer input 36 is supplied to the output 37 which, in this case, is connected to contact NO of the limit switch. Power to the timer circuit is supplied through a manual master control switch 38, safety temperature sensitive switches 39 and 40 and the fuse 34.

In operation, when the feed plate in its forward position to which it is returned after each stroke, the limit switch is actuated and contact NO is connected to contact C and to the motor 14. The master control switch is moved from its off (open) to its on (closed) position such that power is supplied to the timer circuit 35. After the predetermined delay which is determined by adjusting the potentiometer 41, power is applied at the timer output 37 and, consequently, to the motor 14 through the limit switch terminals NO and C. The motor output shaft begins to turn which breaks the connection from NO to C. At the same time the connection between limit switch terminals NC and C is made so that power continues to be supplied to the motor. The timer resets automatically. When the output shaft of the motor has made one complete revolution and the feed plate has been retracted and then moved to its forward position, the limit switch is actuated again and the connection from contacts NC and C is broken so that the power supply to the motor is cut off. The timer is actuated to begin the predetermined delay period anew, following which power is supplied to terminal NO to begin actuation of the motor. The motor causes the retracting movement of the feed plate, the output shaft makes one additional revolution and the motor is automatically stopped with the feed plate at its forward position in which the leading tip portion 25 of the feed plate 13 is in engagement with the gate 24, as shown in FIG. 2.

With respect to the temperature sensitive switches 39 and 40 which are provided in the circuit between the source of power and the manual control switch, as seen in FIG. 1 and FIG. 2, one such switch 39 can be mounted adjacent to the output end of the feed mechanism so that if the temperature exceeds a predetermined temperature, such as 330° F., power to the timer is cut off and the feed plate will not retract so as to expose the pelletized fuel in the hopper to the excessive heat. Nevertheless, if such switch is opened during the stroke of the feed plate, the feed plate will return to its forward position before the motor stops. The other temperature sensitive switch can be provided adjacent to the firebox or on the vent or chimney to prevent a continuing supply of fuel if a dangerous temperature is exceeded.

For standard ¼ inch pellets having less than one percent ash designed for household use in standard pellet stoves, the feed trough can be 1½ inches wide with the resilient member being positioned about 9/16 inch above the feed plate. In its forward position the feed plate can extend about 3 inches from the outlet end of the hopper. The motor can be a model No. 3112 motor available from Multi-Products, of Racine, Wis., which operates at about 14 rpm. Consequently, one revolution of the motor takes a little more than 4 seconds. The delay of the timer can be adjusted by the potentiometer from 1 second to about 30 seconds. Such delay begins when the limit switch is actuated, that is, following a complete rotation of the output shaft. Consequently, with the timer set for a 1 second delay, there will be an actual cycle time of a little more than 5 seconds from the time the feed plate begins one retraction until it begins a subsequent retraction. For a delay time of 30 seconds, there will be a little more than 34 seconds cycle time for the feed plate. A delay of 1 second has been found to result in delivering about 4¾ pounds of pellets per hour, whereas a delay of 30 seconds has been found to deliver about ¾ pound of pellets per hour. A normal range for pellet stoves is about one pound to about five pounds per hour.

We claim:

1. Mechanism for feeding fuel pellets to a firebox comprising a pellet hopper having a bottom outlet opening, a feed trough extending generally horizontally from below said hopper outlet opening and having a forward end portion adjacent to the firebox, a feed plate mounted in said trough below said hopper outlet opening such that pellets from said hopper are supported on said feed plate, means for reciprocating said feed plate in said trough between a rearward position adjacent to said hopper and a forward position adjacent to the firebox for advancing feed pellets along said trough from the hopper toward said firebox, a gate member mounted adjacent to said forward end portion of said feed trough and positioned such that said feed plate engages said gate member when said feed plate is in its forward position and closes said feed trough and said hopper from the firebox when said plate is in such position, and said feed plate discharging the pellets through a gap between said gate member and said forward end portion of said feed trough when said feed plate is moved from its forward position to its rearward position.

2. The mechanism defined in claim 1, in which the reciprocating means includes means for normally maintaining the feed plate in its forward position for normally closing the feed trough and hopper from the firebox.

3. The mechanism defined in claim 2, in which the reciprocating means includes means for automatically maintaining the feed plate in its normal forward position for a predetermined delay period between movements of the feed plate to its rearward position and back to its forward position.

4. The mechanism defined in claim 3, including means for adjusting the length of the predetermined delay period.

5. The mechanism defined in claim 3, in which the reciprocating means includes a motor for moving the feed plate and means for sensing the position of the feed plate and controlling the member.

6. The mechanism defined in claim 5, in which the sensing means includes a limit switch and a timer circuit triggered when the feed plate reaches its forward position.

7. The mechanism defined in claim 1, including a resilient member extending across the feed trough in the area of the hopper outlet opening and above the feed plate to prevent pellets from becoming jammed at the hopper outlet opening.

8. The mechanism defined in claim 7, in which the resilient member is a tightly coiled helical spring.

9. The mechanism defined in claim 1, in which the gate member is swingably mounted on the feed trough.

10. The mechanism defined in claim 9, in which the gate member is biased to an upright position by gravity for engagement against the forward end of the feed plate when the plate is in its forward position.

* * * * *